US011697579B2

(12) United States Patent
Kurabe et al.

(10) Patent No.: US 11,697,579 B2
(45) Date of Patent: Jul. 11, 2023

(54) DISPENSING HEAD AND BEVERAGE SERVER

(71) Applicants: ASAHI GROUP HOLDINGS, LTD., Tokyo (JP); ASAHI BREWERIES, LTD., Tokyo (JP); Nippon Light Metal Company, Ltd., Tokyo (JP); TEX E.G., CO. LTD., Tokyo (JP)

(72) Inventors: Yasuhiro Kurabe, Moriya (JP); Yoshihiro Kudo, Tokyo (JP); Hirotsugu Hosono, Tokyo (JP); Takahide Kobayashi, Tokyo (JP)

(73) Assignees: ASAHI GROUP HOLDINGS, LTD., Tokyo (JP); ASAHI BREWERIES, LTD., Tokyo (JP); NIPPON LIGHT METAL COMPANY, LTD., Tokyo (JP); TEX E.G., CO. LTD., Tokyo (JP)

( * ) Notice: Subject to any disclaimer, the term of this patent is extended or adjusted under 35 U.S.C. 154(b) by 0 days.

(21) Appl. No.: 17/727,666

(22) Filed: Apr. 22, 2022

(65) Prior Publication Data

US 2022/0242715 A1 Aug. 4, 2022

Related U.S. Application Data

(63) Continuation of application No. PCT/JP2020/040919, filed on Oct. 30, 2020.

(30) Foreign Application Priority Data

Nov. 1, 2019 (JP) ..... 2019-200204

(51) Int. Cl.
*B67D 1/08* (2006.01)
*B67D 1/04* (2006.01)

(52) U.S. Cl.
CPC ..... *B67D 1/08* (2013.01); *B67D 1/04* (2013.01); *B67D 1/0839* (2013.01);
(Continued)

(58) Field of Classification Search
CPC .. B67D 1/0839; B67D 1/0848; B67D 1/0845; B67D 1/0412; B67D 2001/0822;
(Continued)

(56) References Cited

U.S. PATENT DOCUMENTS 3,231,143 A * 1/1966 Csernyfredp ..... B67D 1/0412 222/399
4,997,111 A * 3/1991 Lowers ..... B67D 1/0412 222/400.7
(Continued)

FOREIGN PATENT DOCUMENTS

EP 2719656 A1 4/2014
JP 2002-068381 A 3/2002
(Continued)

OTHER PUBLICATIONS

Extended European Search Report for European Patent Application No. 20881640.5 dated Dec. 22, 2022.
(Continued)

*Primary Examiner* — Patrick M. Buechner
(74) *Attorney, Agent, or Firm* — Thomas | Horstemeyer, LLP

(57) ABSTRACT

A dispensing head includes a fastening portion fastened to a mouth of a beverage container, a connecting portion to which a gas coupling connected to a gas cylinder via a gas tube is connected, a gas channel configured to cause the connecting portion and the beverage container to communicate with each other, a dispensing portion configured to dispense a beverage injected from the beverage container by a pressure of a gas supplied to the beverage container via the
(Continued)

gas channel, and an operation inhibition mechanism configured to inhibit an operation for connecting the gas coupling to the connecting portion in a state in which the fastening portion is not fastened to the mouth.

10 Claims, 7 Drawing Sheets

(52) U.S. Cl.
CPC ..... *B67D 1/0845* (2013.01); *B67D 1/0848* (2013.01); *B67D 2001/0822* (2013.01)

(58) Field of Classification Search
CPC ..... B67D 1/04; B67D 1/08; B67D 1/0406; B67D 2210/00047; B67D 2210/00049; B67D 2210/00057; B67D 2210/00062
See application file for complete search history.

(56) References Cited

U.S. PATENT DOCUMENTS

| | | | | |
|---|---|---|---|---|
| 6,073,811 | A * | 6/2000 | Costea | B67D 1/06 222/400.7 |
| 9,434,595 | B2 | 9/2016 | Peirsman et al. | |
| 2002/0050498 | A1* | 5/2002 | Celli | B67D 1/0839 222/400.7 |
| 2015/0266713 | A1 | 9/2015 | Peirsman et al. | |
| 2016/0251211 | A1* | 9/2016 | Hill | B67D 1/1252 141/4 |
| 2017/0210610 | A1* | 7/2017 | Henson | B67D 1/0406 |
| 2018/0209566 | A1* | 7/2018 | Szeteli | B67D 7/0294 |
| 2021/0139306 | A1* | 5/2021 | Wolter | B67D 1/0832 |
| 2021/0347626 | A1* | 11/2021 | Cunneen | B67D 1/0888 |

FOREIGN PATENT DOCUMENTS

| | | | |
|---|---|---|---|
| JP | 2011-251056 | A | 12/2011 |
| JP | 4854820 | B1 | 1/2012 |
| WO | 2007/145641 | A1 | 12/2007 |
| WO | 2012/098690 | A1 | 7/2012 |
| WO | 2021/085623 | A1 | 5/2021 |

OTHER PUBLICATIONS

International Search Report for PCT/JP2020/040919 dated Nov. 24, 2020 (partially translated).

* cited by examiner

DISPENSING HEAD AND BEVERAGE SERVER

CROSS-REFERENCE TO RELATED APPLICATION(S)

This application is a continuation of International Patent Application No. PCT/JP2020/040919 filed on Oct. 30, 2020, which claims priority to and the benefit of Japanese Patent Application No. 2019-200204 filed on Nov. 1, 2019, the entire disclosures of which are incorporated herein by reference.

FIELD OF THE INVENTION

The present invention relates to a dispensing head and a beverage server.

DESCRIPTION OF THE RELATED ART

Japanese Patent Laid-Open No. 2002-68381 describes a beer server for supplying beer by supplying carbon dioxide gas to a beer container. The beer server includes a lower base portion including a cooler, a mount body mounted on the mouth of the beer container, and a tap for dispensing beer supplied from the mount body. Carbon dioxide gas is supplied from a carbon dioxide gas cartridge to the mount portion via a carbon dioxide gas tube.

In the beer server described in Japanese Patent Laid-Open No. 2002-68381, even if the mount body is mounted on the mouth of the beer container or is not mounted thereon, a gas tube can be connected to the mount portion. For this reason, when the gas tube is connected to the mount body in a state in which the mount body is not mounted on the mouth of the beer container, the carbon dioxide gas in the carbon dioxide gas cartridge is discharged to the atmosphere. Accordingly, the carbon dioxide gas may be wasted.

SUMMARY OF THE INVENTION

The object of the present invention is to provide a dispensing head and a beverage server which are advantageous in preventing the gas in the gas cylinder from being wasted.

The first aspect of the present invention relates to a dispensing head including a fastening portion fastened to a mouth of a beverage container, the dispensing head comprising a connecting portion to which a gas coupling connected to a gas cylinder via a gas tube is connected, a gas channel configured to cause the connecting portion and the beverage container to communicate with each other, a dispensing portion configured to dispense a beverage injected from the beverage container by a pressure of a gas supplied to the beverage container via the gas channel, and an operation inhibition mechanism configured to inhibit an operation for connecting the gas coupling to the connecting portion in a state in which the fastening portion is not fastened to the mouth.

The second aspect of the present invention relates to a beverage server, the beverage server comprising a dispensing head according to the first aspect and a storage portion configured to store a beverage container.

Further features of the present invention will become apparent from the following description of exemplary embodiments with reference to the attached drawings.

DESCRIPTION OF THE EMBODIMENTS

Figure 1:
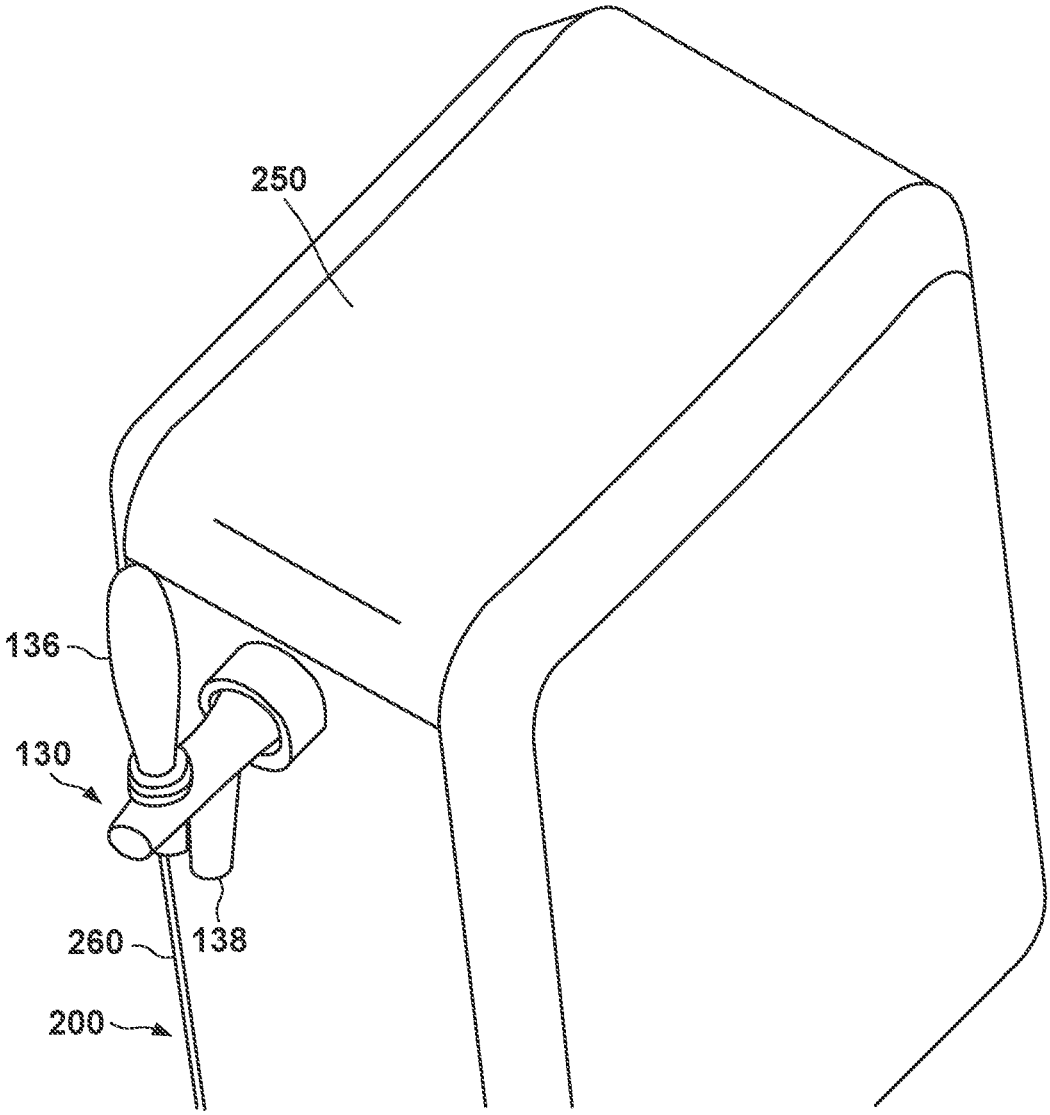
FIG. 1 is a perspective view showing a beverage server according to an embodiment of the present invention.
Figure 2:
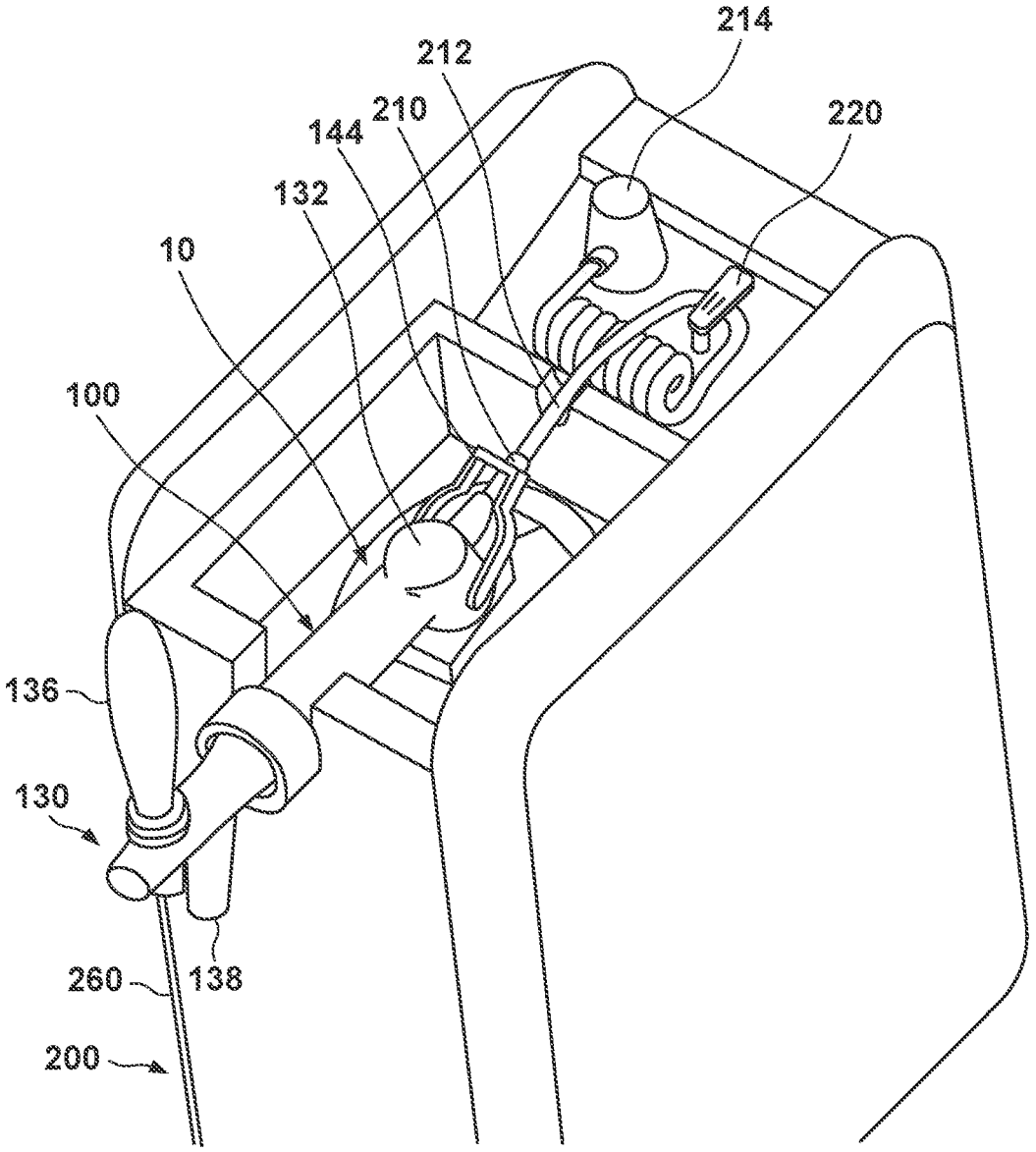
FIG. 2 is a perspective view showing a state in which a lid portion is removed from the beverage server according to the embodiment of the present invention.
Figure 3:
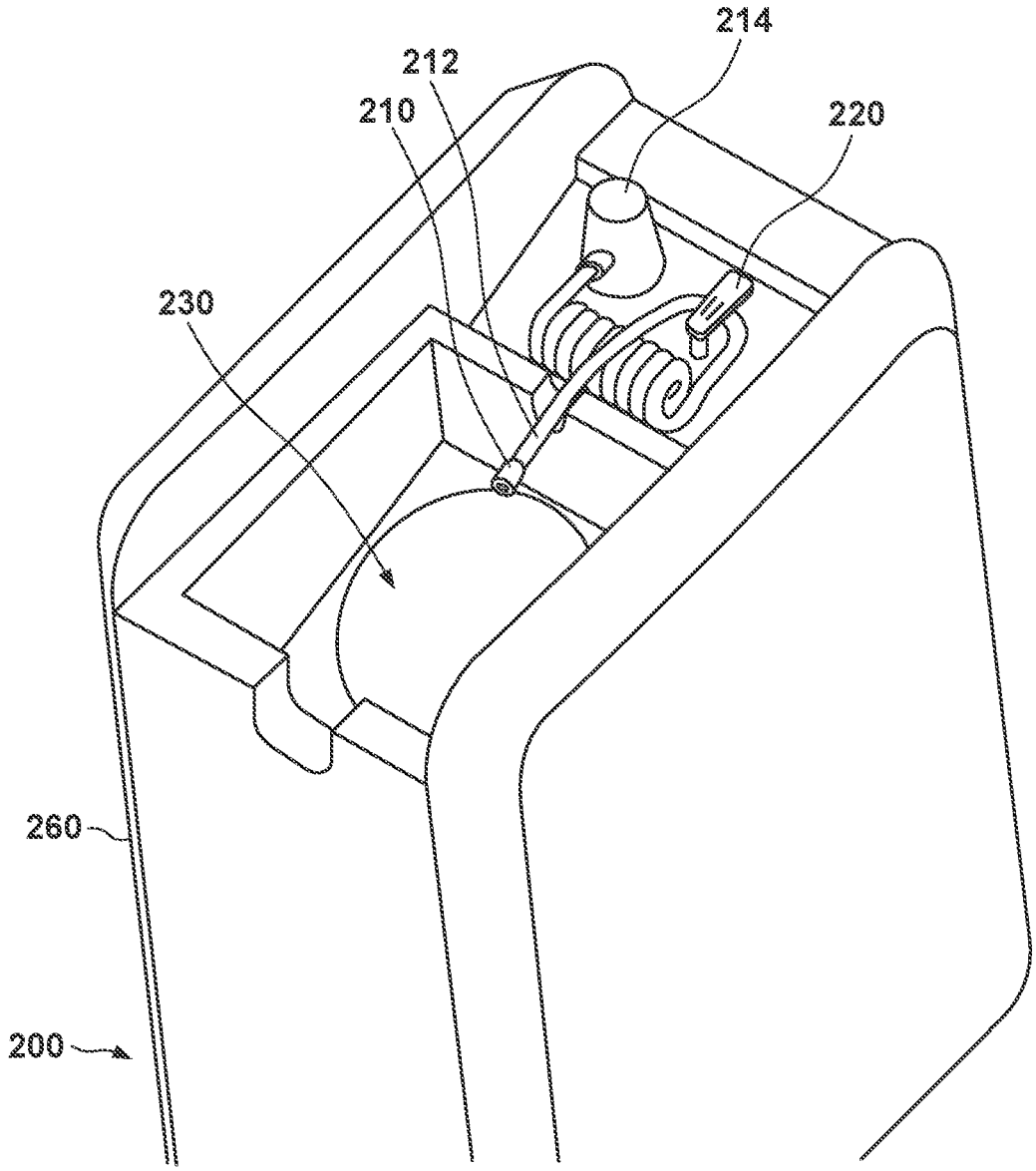
FIG. 3 is a perspective view showing the main body of the beverage server according to the embodiment of the present invention.

Hereinafter, embodiments will be described in detail with reference to the attached drawings. Note, the following embodiments are not intended to limit the scope of the claimed invention, and limitation is not made to an invention that requires a combination of all features described in the embodiments. Two or more of the multiple features described in the embodiments may be combined as appropriate. Furthermore, the same reference numerals are given to the same or similar configurations, and redundant description thereof is omitted.

FIGS. 1, 2, 3, and 4 show an arrangement of a beverage server 200 according to an embodiment of the present invention. The beverage server 200 is arranged to dispense a beverage (for example, beer) in a beverage container 10 into a container such as a mug or glass from a dispensing port 138 using the pressure of the gas such as carbon dioxide gas. The beverage server 200 can include a main body 260 and a dispensing head 100. The main body 260 can include a storage portion 230 for storing the beverage container 10 and a storage portion 240 for storing a gas cylinder 20. The storage portion 230 can hold the beverage container 10 in a state in which the axial direction of the beverage container 10 is tilted with respect to the vertical direction. The beverage server 200 or the main body 260 may include a lid portion 250. The beverage container 10, the gas cylinder 20, and the dispensing head 100 can be mounted in the main body 260 in a state in which the lid portion 250 is open, and after that the lid portion 250 can be closed. Although not shown, the beverage server 200 can include a cooling unit (not shown) for cooling the beverage in the beverage container 10 and/or the beverage injected from the beverage container 10 and supplied to the dispensing port 138. The cooling unit can include, for example, a Peltier element.

FIGS. 5, 6, 7, 8, and 9 show the dispensing head 100. The dispensing head 100 is arranged to dispense the beverage in the beverage container 10 into a container such as a mug or glass from the dispensing port 138 by using a gas such as carbon dioxide gas supplied from the gas cylinder 20. Here, the beverage container 10 includes a down tube for injecting the beverage outside the beverage container 10 and the dispensing head 100 can supply the gas supplied from the gas cylinder 20 to a space portion (the space on the liquid surface of the beverage) in the beverage container 10. By pressing the liquid surface of the beverage by the gas, the beverage is injected from the beverage container 10 via the down tube. The dispensing head 100 can be arranged to include an operation portion 136 such as an operation lever to open a valve (not shown) by operating the operation portion 136, thereby dispensing the beverage in the beverage container 10 from the dispensing port 138. The dispensing head 100 may have a function of generating bubbles in accordance with the operation of the operation portion 136.

The dispensing head 100 can include a fastening portion 110 fastened to a mouth 12 of the beverage container 10. The dispensing head 100 can include a connecting portion 120, a gas channel 122, a dispensing portion 130, and an operation inhibition mechanism 140. A gas coupling 210 is connected to the connecting portion 120. The gas cylinder 20 is connected to the gas coupling 210 via a gas tube 212. The gas channel 122 causes the connecting portion 120 and the beverage container 10 to communicate with each other. The dispensing portion 130 dispenses, via a dispensing valve assembly 132, the beverage injected from the beverage container 10 by the pressure of the gas supplied to the beverage container 10 via the gas channel 122. The operation inhibition mechanism 140 inhibits an operation of connecting the gas coupling 210 to the connecting portion 120 in a state in which the fastening portion 110 is not fastened to the mouth 12 of the beverage container 10.

The operation inhibition mechanism 140 includes a contact portion 142 that contacts the beverage container 10 when the fastening portion 110 is fastened to the mouth 12 of the beverage container 10 and can release inhibition of the operation for connecting the gas coupling 210 to the connecting portion 120 in accordance with the contact of the contact portion 142 to the beverage container 10. The operation inhibition mechanism 140 can include an interference member 144 for interfering the operation of connecting the gas coupling 210 to the connecting portion 120. The interference member 144 can operate interlockingly with the operation of the contact portion 142 and release, in accordance with the contact of the contact portion 142 to the beverage container 10, the inhibition of the operation for connecting the gas coupling 210 to the connecting portion 120. The interference member 144 can include a cover for covering all or part of the connecting portion 120 to interfere the operation of connecting the gas coupling 210 to the connecting portion 120.

Figure 9:
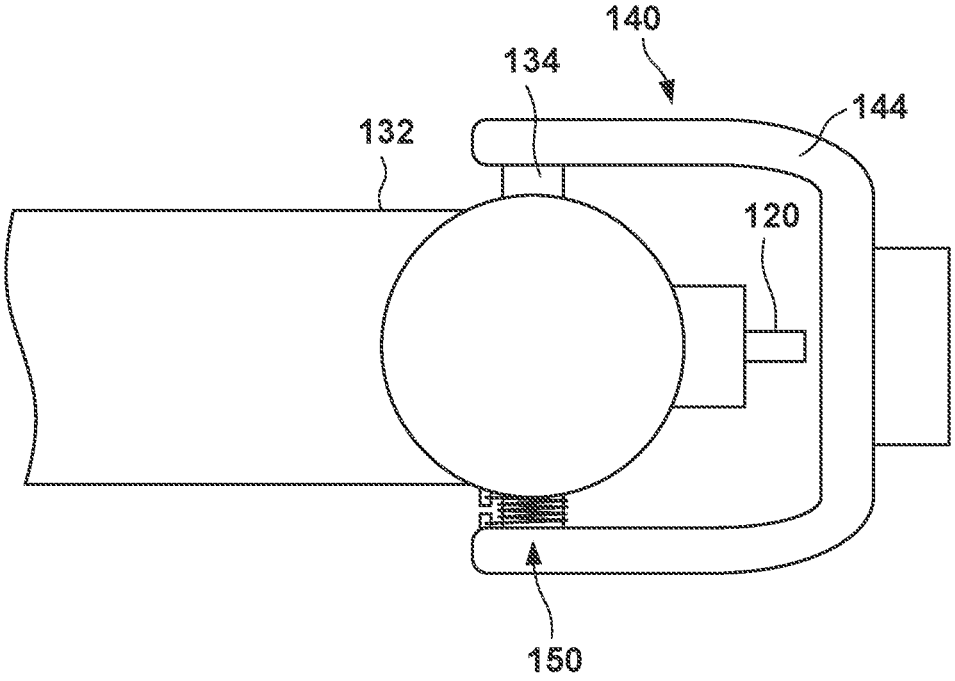
FIG. 9 is a view exemplifying a state maintaining portion for maintaining an operation for connecting a gas coupling to a connecting portion in a state in which an interfering member interferes.

As an example, the contact portion 142 and the interference member 144 can form an integrated pivot member and can be supported to allow the pivoting operation of the pivot member within a range of a predetermined pivot angle around a shaft 134. The operation inhibition mechanism 140 can include a state maintaining portion 150 for maintaining the state in which the operation for connecting the gas coupling 210 to the connecting portion 120 is interfered by the interference member 144 in a state in which the fastening portion 110 is not fastened to the mouth 12 of the beverage container 10. FIG. 9 shows an example of the arrangement of the state maintaining portion 150. The state maintaining portion 150 can include a force applying portion for applying a force to the interference member 144. The force applying portion can include, for example, a torsion spring, leaf spring, or a coil spring. The force applying portion, for example, can accumulate a restoration force in a state in which the fastening portion 110 is fastened to the mouth 12 of the beverage container 10. In addition, the force applying portion can operate to cause the interference member 144 to interfere the operation of connecting the gas coupling 210 to the connecting portion 120 by the restoration force in accordance with the operation of removing the fastening portion 110 from the mouth 12 of the beverage container 10. In the example illustrated in FIG. 9, the partial state (the force applying portion) by arranging the torsion spring to the shaft 134 is arranged.

Figure 5:
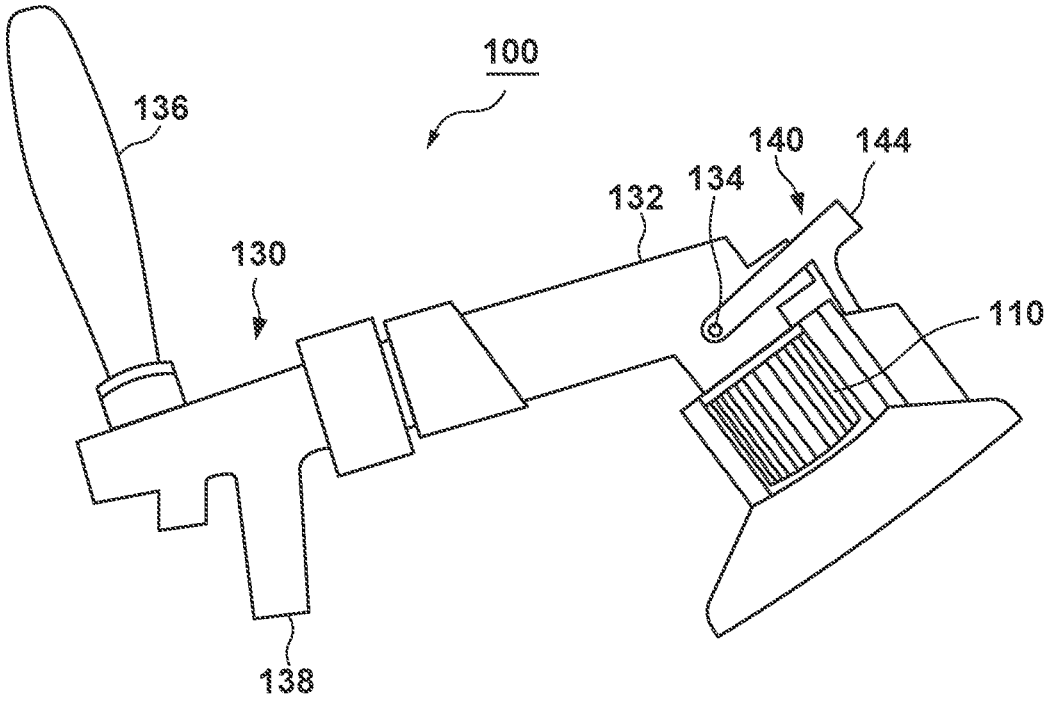
FIG. 5 is a side view showing a dispensing head (the state in which the dispensing head is not mounted on the beverage container) of the beverage server according to the embodiment of the present invention.
Figure 6:
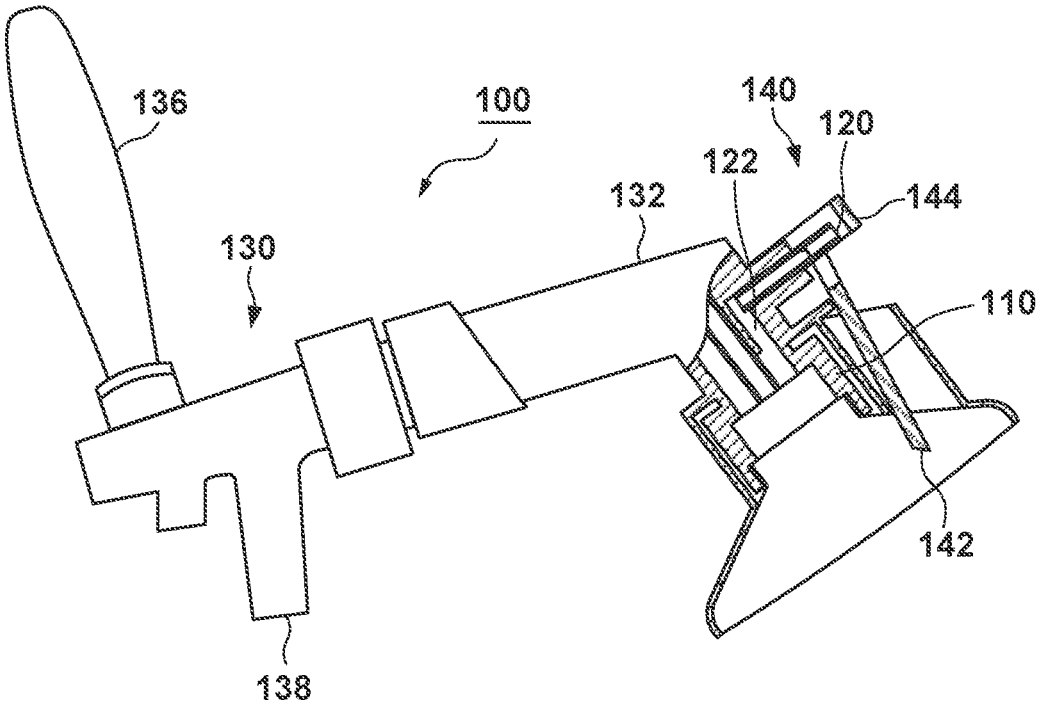
FIG. 6 is a sectional view showing the dispensing head (the state in which the dispensing head is not mounted on the beverage container) of the beverage server according to the embodiment of the present invention.

FIGS. 5 and 6 exemplify a state in which the interference member 144 interferes the operation of connecting the gas coupling 210 to the connecting portion 120 since the dispensing head 100 is not connected to the mouth 12 of the beverage container 10. In this state, the user cannot perform an operation of connecting the gas coupling 210 to the connecting portion 120 of the dispensing head 100. Accordingly, in the state in which the dispensing head 100 is not connected to the mouth 12 of the beverage container 10, a case in which the gas coupling 210 is connected to the connecting portion 120 and accordingly a case in which the gas in the gas cylinder 20 is discharged wastefully to the atmosphere can be prevented.

Figure 7:
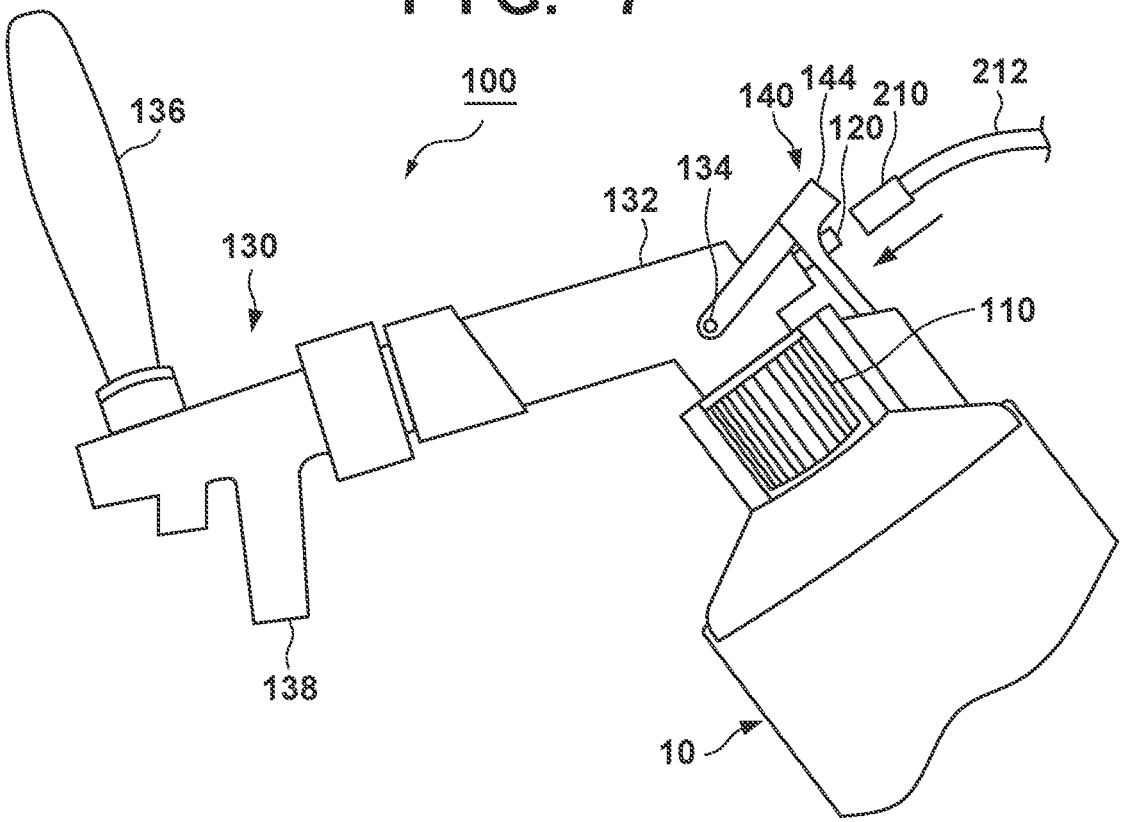
FIG. 7 is a side view showing the dispensing head (the state in which the dispensing head is mounted on the beverage container) of the beverage server according to the embodiment of the present invention.
Figure 8:
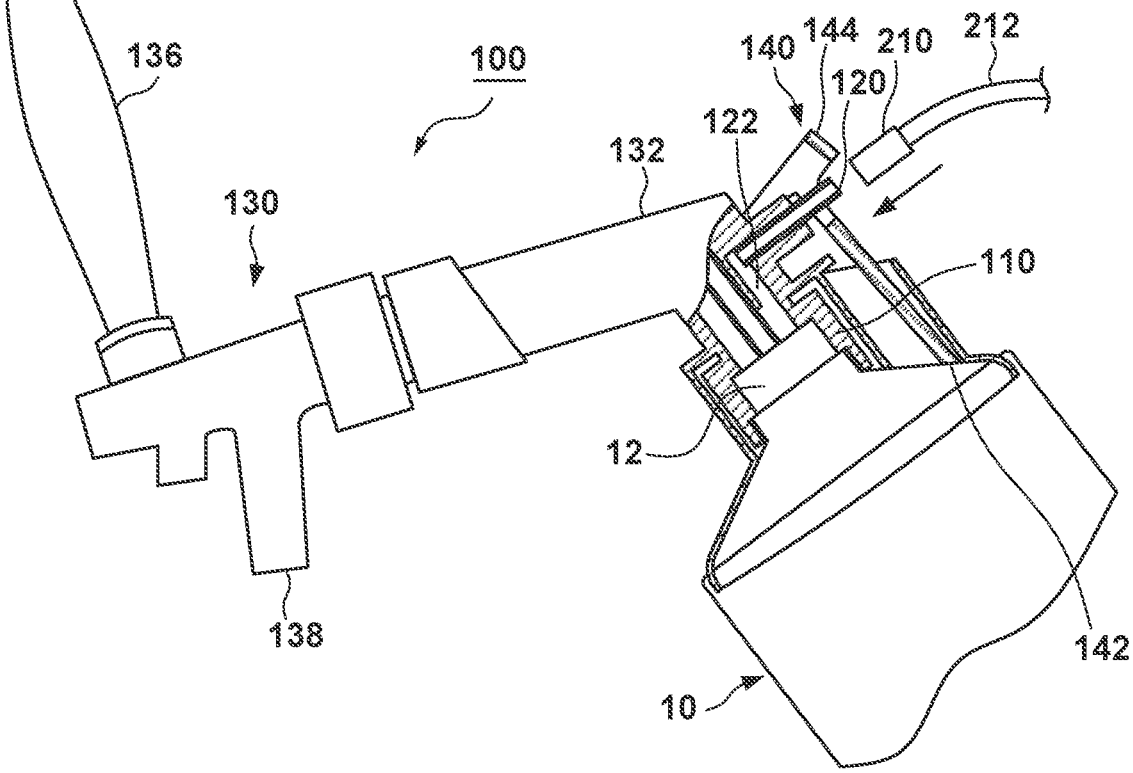
FIG. 8 is a sectional view showing the dispensing head (the state in which the dispensing head is mounted on the beverage container) of the beverage server according to the embodiment of the present invention.

FIGS. 7 and 8 exemplify a state in which the operation of connecting the gas coupling 210 to the connecting portion 120 is possible since the dispensing head 100 is connected to the mouth 12 of the beverage container 10. The gas coupling 210 can be arranged to include, for example, a valve (not shown) that is set in the open state by connecting the gas coupling 210 to the connecting portion 120 and in the closed state by disconnecting the gas coupling 210 from the connecting portion 120.

Figure 4:
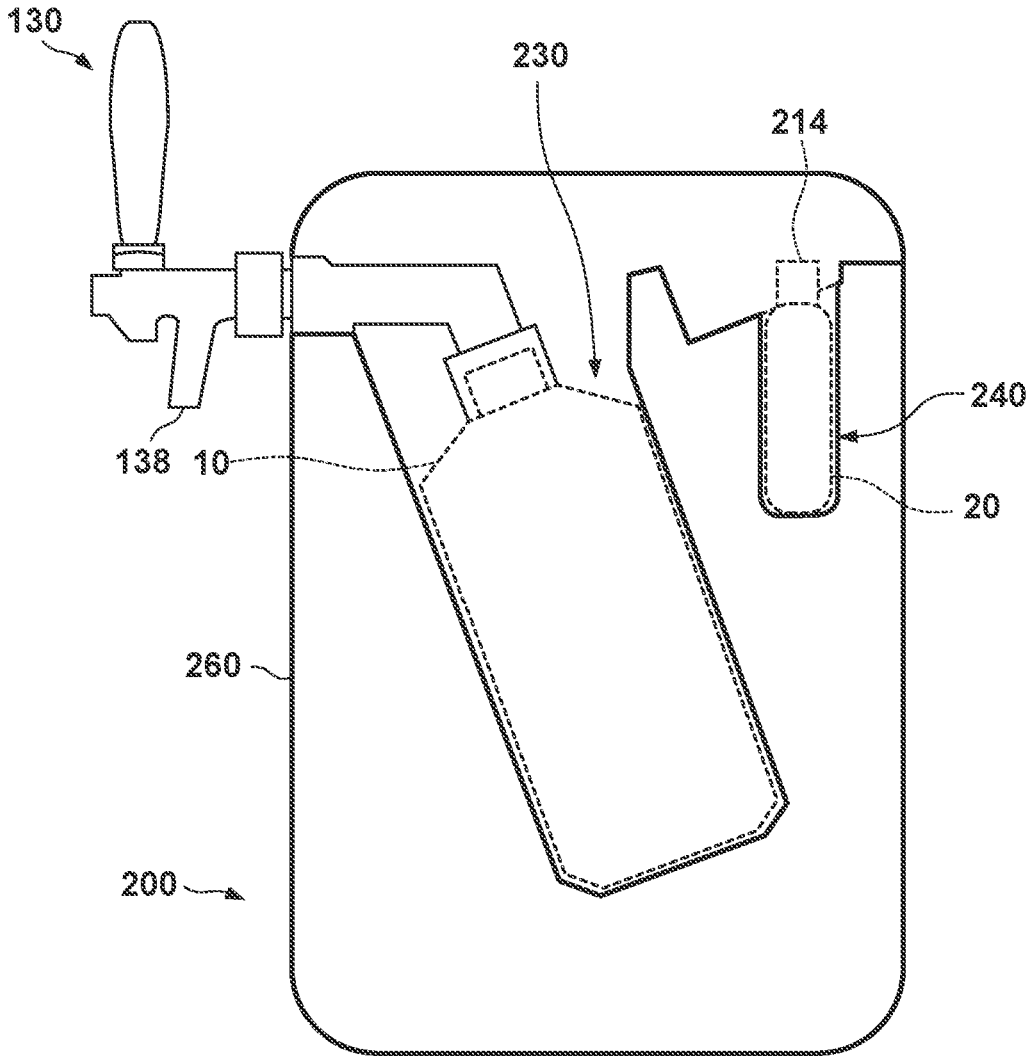
FIG. 4 is a fluoroscopic view showing the beverage server according to the embodiment of the present invention.

As shown in FIG. 4, a gas head 214 can be mounted on the gas cylinder 20. The gas in the gas cylinder 20 can be supplied to the gas tube 212 via the gas head 214. The gas head 214 may include, for example, a regulator. As exemplified in FIGS. 2 and 3, the beverage server 200 or the main body 260 can include a regulating portion 220 for regulating the movable range of the gas coupling 210. The regulating portion 220 can regulate the movable range of the gas coupling 210 so as not to remove the beverage container 10 from the storage portion 230 if the gas coupling 210 has already been disconnected from the connecting portion 120. By providing the regulating portion 220, removal of the dispensing head 100 (the fastening portion 110) from the beverage container 10 in a state in which the gas coupling 210 is connected to the connecting portion 120 (a state in which the gas can be supplied from the gas cylinder 20 to the dispensing head 100) can be prevented. Accordingly, wasteful discharge of the gas to the atmosphere from the gas cylinder 20 via the dispensing head 100 can be prevented. As exemplified in FIGS. 2 and 3, the regulating portion 220 can regulate the movable range of the gas coupling 210 by fixing part of the gas tube 212.

The invention is not limited to the foregoing embodiments, and various variations/changes are possible within the spirit of the invention.

REFERENCE SIGNS LIST

10: beverage container, 12: mouth, 20: gas cylinder, 100: dispensing head, 110: fastening portion, 120: connecting portion, 122: gas channel, 130: dispensing portion, 132: dispensing valve assembly, 136: operation portion, 140: operation inhibition mechanism, 142: contact portion, 144:

interference member, 150: state maintaining portion, 200: beverage server, 210: gas coupling, 212: gas tube, 214: gas head, 220: regulating portion, 230: storage portion, 240: storage portion, 250: lid portion, 260: main body

What is claimed is:

1. A dispensing head including a fastening portion fastened to a mouth of a beverage container, comprising a connecting portion to which a gas coupling connected to a gas cylinder via a gas tube is connected, a gas channel configured to cause the connecting portion and the beverage container to communicate with each other, a dispensing portion configured to dispense a beverage injected from the beverage container by a pressure of a gas supplied to the beverage container via the gas channel, and an operation inhibition mechanism configured to inhibit an operation for connecting the gas coupling to the connecting portion in a state in which the fastening portion is not fastened to the mouth.

2. The dispensing head according to claim 1, wherein the operation inhibition mechanism includes a contact portion configured to contact the beverage container when fastening the fastening portion to the mouth and releases inhibition of the operation in accordance with contact of the contact portion to the beverage container.

3. The dispensing head according to claim 2, wherein the operation inhibition mechanism includes an interference member configured to interfere the operation of connecting the gas coupling to the connecting portion, and the interference member operates interlockingly with the contact portion and releases inhibition of the operation in accordance with contact of the contact portion to the beverage container.

4. The dispensing head according to claim 3, wherein the operation inhibition mechanism includes a state maintenance portion configured to maintain a state in which the interference member interferes the operation in a state in which the fastening portion is not fastened to the mouth.

5. The dispensing head according to claim 3, wherein the interference member includes a cover configured to interfere the operation by covering all or part of the connecting portion.

6. A beverage server comprising a dispensing head defined in claim 1, and a storage portion configured to store a beverage container.

7. The beverage server according to claim 6, further comprising a regulating portion configured to regulate a movable range of the gas coupling so as not to remove the beverage container from the storage portion not in a state in which the gas coupling is disconnected from the connecting portion.

8. The beverage server according to claim 7, wherein the regulating portion regulates the movable range of the gas coupling by fixing part of the gas tube.

9. The beverage server according to claim 6, wherein the gas coupling includes a valve, and the valve is set in an open state by connecting the gas coupling to the connecting portion and in a closed state by disconnecting the gas coupling from the connecting portion.

10. The beverage server according to claim 6, wherein the storage portion holds the beverage container in a state in which an axial direction of the beverage container is tilted with respect to a vertical direction.

* * * * *